United States Patent [19]

Schwarz et al.

[11] 4,172,475

[45] Oct. 30, 1979

[54] WEAVING MACHINE SIMULTANEOUSLY CONTROLLED BY A JACQUARD MACHINE AND A DOBBY

[75] Inventors: Rudolf Schwarz, Horgen; Otto Müeller, Uetikon am See, both of Switzerland

[73] Assignee: Staeubli Ltd., Zurich, Switzerland

[21] Appl. No.: 910,981

[22] Filed: May 30, 1978

Related U.S. Application Data

[63] Continuation of Ser. No. 817,255, Jul. 20, 1977, abandoned.

[30] Foreign Application Priority Data

Jul. 21, 1979 [CH] Switzerland ..... 9358/76

[51] Int. Cl.[2] ..... D03C 1/00; D03C 1/02; D03C 3/00

[52] U.S. Cl. ..... 139/66 R; 139/59; 139/68

[58] Field of Search ..... 139/55.1, 59, 66 R, 139/68, 71, 1 R, 1 E, 317, 328, 331, 327

[56] References Cited

U.S. PATENT DOCUMENTS

| | | | |
|---|---|---|---|
| 1,158,782 | 11/1915 | Brander et al. | 139/61 |
| 1,672,434 | 6/1928 | Staubli | 139/68 |
| 3,381,719 | 5/1968 | Favre | 139/68 |

*Primary Examiner*—James Kee Chi

*Attorney, Agent, or Firm*—Blanchard, Flynn, Thiel, Boutell & Tanis

[57] ABSTRACT

A weaving machine comprising a dobby and a Jacquard machine as the control members, wherein the dobby is controlled from a single pattern card in the Jacquard machine. Harness cords connect the Jacquard hooks to the heddles and to a movably supported member in the dobby. The coordinated movements of the Jacquard hooks will effect a simultaneous movement of the movably supported member in the dobby so that operations of the Jacquard machine in response to the information on the pattern card will simultaneously effect an operation of the dobby.

6 Claims, 4 Drawing Figures

WEAVING MACHINE SIMULTANEOUSLY CONTROLLED BY A JACQUARD MACHINE AND A DOBBY

This is a continuation of application Ser. No. 817,255, filed July 20, 1977, now abandoned.

FIELD OF THE INVENTION

The invention relates to a weaving machine having a dobby and a Jacquard machine for simultaneously controlling the shed opening with a single control card in the Jacquard machine, wherein Jacquard hooks and harness cords are arranged between the Jacquard machine and the dobby for transmitting the impulses.

BACKGROUND OF THE INVENTION

The dobby and the reversible Jacquard machine differ with respect to the control among others in that the former one follows the classic weft-logic method of operation while the latter one has, in the case of a change in the direction of rotation, only after at least one weft has run off, the logical shed formation. These basic different characteristics can be observed during the weft searching function at which time the machine group is rotated both forwardly and also in reverse over a sequence of wefts. Because of a reversal in the direction of rotation of a weaving machine with the two shed-forming machines which are each controlled by one pattern card, the pattern card of one of the two machines must be adjusted manually for the mentioned reason so that both at a given time simultaneously open the same shed. Such an action, which must take place twice per weft operation, is not only time consuming, but leads in the case of an erroneous manipulation or forgotten adjustment to a serious breakdown in the synchronous run of the two shed-forming machines.

In order to eliminate breakdowns in the synchronous run of both shed-forming machines and to simplify the weft searching operation and to handle it quicker, it has been suggested to control both machines by one single pattern card which is built into the Jacquard machine, wherein the control impulses are transmitted therefrom by means of harness cords to the dobby.

Such an arrangement is described in German OS No. 2,256,636, wherein the demand for a synchronous run at any desired change in the direction of rotation due to a weft searching operation is not met in the sense of the mentioned objective.

The purpose of the invention is to drivingly connect both shed-forming machines nonchangably and synchronously to the main shaft of the weaving machine and to control them together from the Jacquard pattern card so that for weft searching, the main shaft together with the two shed-forming machines are rotated back for taking out one or several successive weft threads and the latest after two rotations, the machine group opens the desired shed or the shed row. After the weft searching has taken place in the reverse run, the shed of the last removed weft thread is adjusted again for further weaving in the forward direction, the latest after two shaft rotations, without necessitating during the entire weft search a manual adjustment of the pattern card for the needs of the dobby. The efficiency of the machine is therewith increased by a quicker weft search and by avoiding weaving errors.

This is made possible with a weaving machine of the abovementioned type, which is characterized inventively by a corresponding shed opening taking place in a common reverse rotation and subsequent forward rotation of the two shed-forming machines without requiring a manual adjustment of the control mechanism.

Thus the solution is to control each frame-lift unit of each four hooks and four harness cords of the Jacquard machine in such a manner that two cords transmit the control impulses for the new weft and two cords transmit the impulses for the passed weft into the dobby one time during each rotation of the weaving machine, wherein on the input side of the dobby a known needle device having, on the one hand, four reading needles is influenced or, on the other hand, each of two known control levers of a cam-controlled dobby unit is controlled by one clasp handle for the new weft and each clasp handle for the passed weft into one of two possible end positions, and between the cord and the reading needle there is inserted a pawlless impulse converter or rather between two clasp handles and one control lever or draw hook there is inserted a rocker arm for two end positions for the control or release function, so that a control impulse which is introduced into the dobby at any desired time is passed on at a given time.

BRIEF DESCRIPTION OF THE DRAWINGS

Two exemplary embodiments of the subject matter of the invention are illustrated in the drawings, in which.

DETAILED DESCRIPTION

Figure 1:
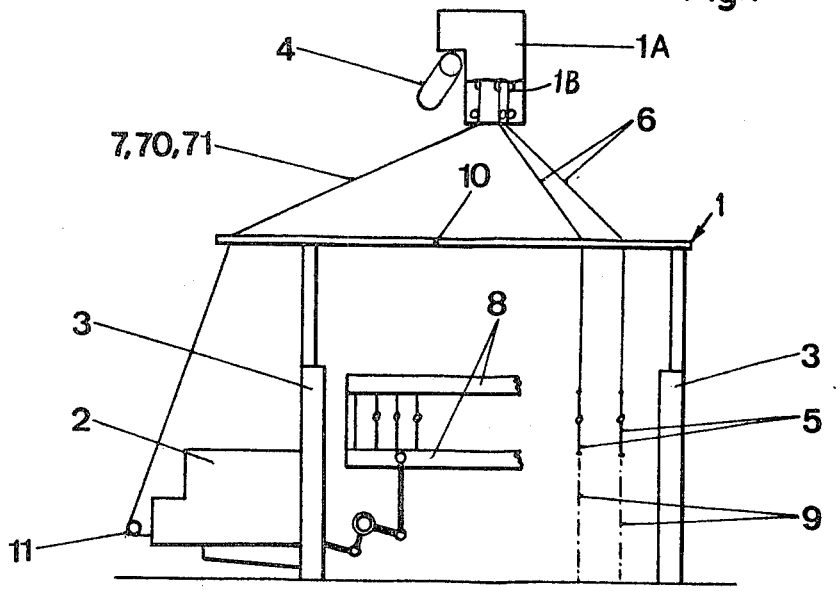
FIG. 1 is a schematic view of a weaving machine having two control devices.

The frame of the weaving machine is identified by the reference numeral 1 in the weaving machine system of FIG. 1. A Jacquard machine 1A which controls the heddles 5 through the harness cords is secured to one part of the frame 1 and a dobby 2 which controls the heddle frames 8 is secured to another part 3 thereof. A controlled indexing of a single pattern card 4 controls the Jacquard hooks 1B of the Jacquard machine in a patterned manner, which patterned control is transmitted onto the dobby through the harness cords 7, 70, 71. Reference numeral 10 identifies a lower hole or comber board which is used to guide the harness cords 6, 7, 70, 71. Reference numeral 11 is a guide roller for the harness cords 7, 70, 71 to the dobby. The harness cords 6 including the heddles 5 of the Jacquard machine are pulled by the springs 9 into the lower-shed position.

Figure 2:
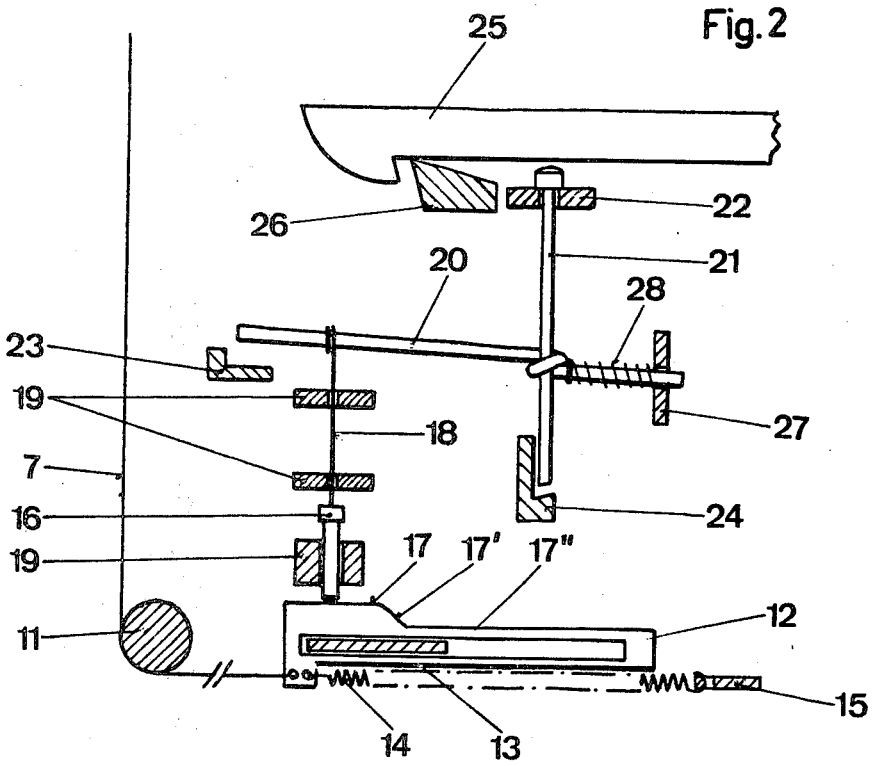
FIG. 2 illustrates the control parts of a dobby.
Figure 3:
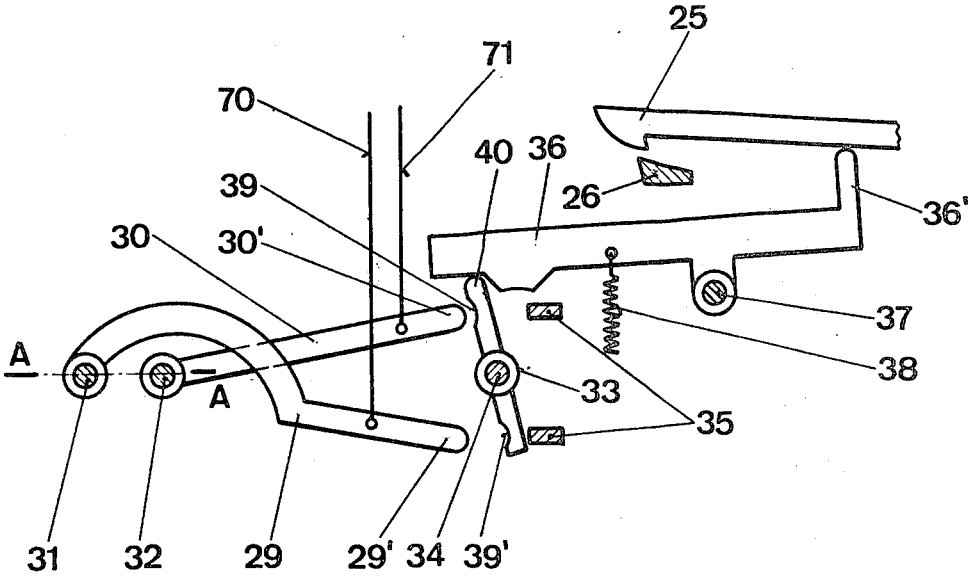
FIGS. 3 and 4 illustrate a modification of the control parts of a dobby in two positions thereof.
Figure 4:
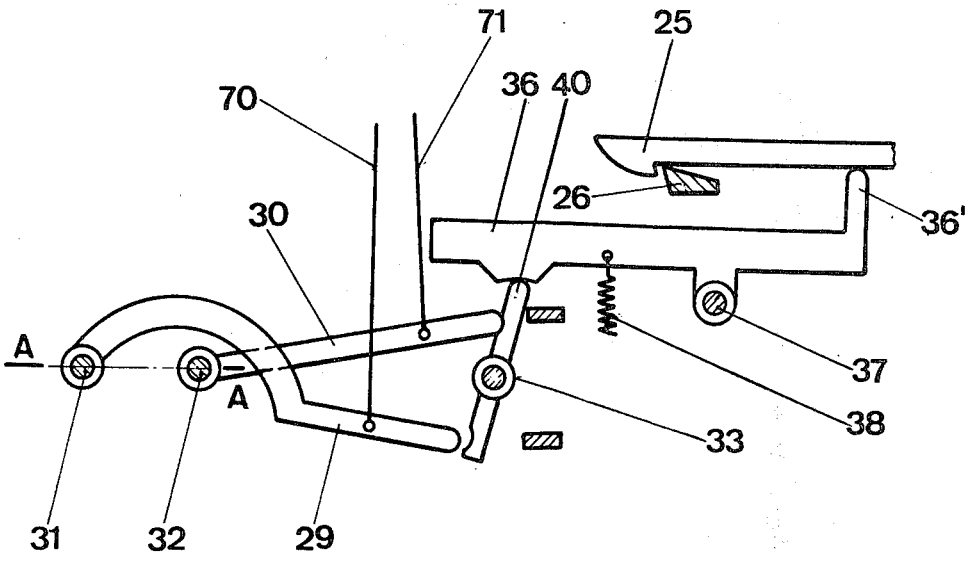

The partial sections of a known dobby which are illustrated in FIGS. 2 to 4 show the reading and control members which act with their control needles 21 or levers 36' to control the position of a draw hook 25 which is shown to be in the rear deadcenter position. Each of the draw hooks is engaged by and pulled rightwardly by the draw knives 26. We refer here for example to a dobby of the Hattersley type.

In the case of the dobby according to FIG. 2 we refer to a machine which is controlled weft logically and the draw hooks 25 are controlled in a conventional manner from four reading needles 18 which assure at any time a full forward or reverse run. Since the control impulses are transmitted from the Jacquard machine through the cord 7 during the entire shed-moving time, these impulses are selected directly in advance to constitute in anticipatory control which is maintained until after the weft insertion operation, so that the anticipatory control feature can also effect an advance selection for the reverse run.

For reasons of simplicity in illustration, FIG. 2 illustrates only a single harness cord 7, a single reading needle 18 of four reading needles per frame-lift unit and a single sequence of control elements for one lower draw hook.

The cam carriage 12 is secured to the harness cord 7 which is guided over the guide roller 11 and is pulled by the spring 14 to the right fixed to the fixed abutment 15. The cam carriage 12 has on its upper side two parallel support or cam surfaces 17 and 17" which are connected by a ramp surface 17'. The vertically movable reading needle 18 is supported and slides on the cam surfaces 17, 17' and 17". The longitudinal extent of the ramp 17' in the horizontal direction is less than the path of movement of the cam carriage 12 and the center part of the ramp surface 17' is in the moment of the shed crossing primarily below the reading needle 18. The reading needle 18 slides vertically in the guideways 19. It has a plunger part 16 at its lower end while the upper end is wound around a horizontally extending auxiliary needle 20. The auxiliary needle 20 is, in turn, looped around the control needle 21. A horizontally movable sliding rail 23 is associated with the auxiliary needle 20, that is, the sliding rail 23 engages a lowered auxiliary needle 20 and moves it to the right. A spring 28 which is supported on a guideway 27 moves the needle 20 back to the original position. The control needle 21 itself is received in a guideway 22 and is moved upwardly from the illustrated position by a vertically movable lift bar 24. The return movement of the control needle 21 is effected by the weight of the control needle 21 and draw hook 25. All parts from the reading needle 18 to the draw knife 26 and their operation have been known for decades.

If the carriage 12 is in the illustrated position, that is a control impulse does not take place from the pattern card 4 of the Jacquard machine 1A, then the reading needle 18 and thus the auxiliary needle 20 is lifted up. This corresponds to a nonperforated location on the pattern card. The sliding rail 23 slides by below and past the auxiliary needle 20. The control needle 21 remains in place and is lifted up by the lift bar 24 and takes with it the draw hook 25. The latter movement is possible only during a shed standstill, thus after a control by the Jacquard machine.

If a hole of the pattern card is read, a pull by the harness cord 7 onto the carriage 12 occurs and effects a movement to the left. The reading needle 18 and the auxiliary needle 20 are lowered by their own weight over the ramp surface 17' onto the support surface 17". After this the sliding rail 23 moves into engagement with and causes the auxiliary needle 20 and thus the control needle 21 to move to the right, so that the latter is not engaged by the vertically movable lift bar and lifted up. The draw hook 25 is thereafter taken along by the draw knife 26.

The control ramp 17' assures that the reading needle 18 is controlled approximately at the same time, as if the dobby would be controlled by a separate pattern card.

As long as the cam carriage 12 remains in the pattern-like controlled position, both the forward and the reverse run of the draw hooks will always be correctly controlled. Due to the provision of four harness cords 7 and four reading needles 18 and four cam carriages 12—two for the forward run and two for the reverse run—the machine can operate at any time weft-logically. A reversal in the direction of rotation is possible at any time. The latest after two rotations of the main shaft in the reverse run for taking out the last inserted weft thread, the shed is opened, after which each further rotation opens the shed for each preceding weft. A return of the machine unit without any problems through any number of wefts is possible and without manipulation of the card cylinder. The dobby and Jacquard machine operate synchronously according to the open shed double lift principle.

In place of the cam carriage it is also possible to provide a double-arm rocking lever wherein the harness cord 7 is connected to one arm, the other arm being provided below the reading needle 18 in the place of a pattern card. The rocking lever is held by a spring in a position to support the reading needle. The harness cord then pulls the rocking lever into the holding-down position of the reading needle.

In FIG. 3, we refer to the illustration of an inventive device on a known cam-card-controlled dobby. The device is illustrated with only a single draw hood 25 and consists of two harness cords 70, 71, one for the new and the other for the previous weft. Clasp handles 29, 30 are connected to the harness cords and are freely rotatably supported on each of a pair of shafts 31 and 32. A rocker arm 33 is freely rotatably supported on a shaft 34. The limits of rotation of the rocker arm 33 is defined by the stops 35. A known control lever 36 is freely rotatably supported on a shaft 37. Its lever part 36' at one end functions as the control member for the draw hook 25 to effect a lifting of same off from the knife against the force of a spring 38, when the rocker arm 33 does not move the control lever. If the left end of the control lever 36 is lifted up by the rocker arm 33 in response to the nose 30' of the clasp handle 30 being received in the notch 39, the draw hook 25 is then lowered onto the draw knife 26 and is taken along by same (FIG. 4).

FIG. 3 illustrates the position of the control device of the dobby after receiving a control impulse from the pattern card or the Jacquard machine. This advance or anticipatory control is maintained to the end of the shed standstill and the draw hook 25 can be controlled in the usual time and independent from the actions in the Jacquard machine.

The clasp handle 29 receives from the harness cord 70 the control impulse for the preceding weft while the clasp handle 30 receives through the harness cord 71 the impulse for the new weft. Both impulse inputs take place simultaneously, while the shafts 31, 32 which are movable on the path A—A are moved totally to the left. After this and when the draw knife 26 has returned into the initial position, first the shaft 31 moves with the clasp handle 29 to the right and the nose 29' is received in the notch 39' of the rocker arm 33, in order to confirm the control position which has been obtained for the preceding weft. Subsequently the shaft 31 returns with the clasp handle 29 to the initial position while the shaft 32 with the clasp handle 30 moves toward the rocker arm 33 in order to move same into the position which corresponds with the control impulse which has been transmitted by the harness cord 71. Thus, referring to FIG. 3, the clasp handle 29 would transmit the result of a nonperforated location on the pattern card as a command in the confirming sense to the rocker arm 33, the control lever 36 and the draw hook 25, while subsequently the clasp handle 30 will transmit the result of a perforated location onto the draw hook 25. A known control method is applied with these means and is a condition for the logic method of operation.

The dobby can be moved at any time into the other direction of rotation and can thereby at all times correctly open the shed.

FIG. 4 shows in continuation of FIG. 2 the new condition. Due to the lowering of the control lever arm 36', the draw hook 25 is positioned in front of the draw knife 26. During the next lift of the draw knife, the frame is moved into the upper-shed position.

The end 40 of the rocker arm 33 can by leaving out the control lever 36 also engage directly under the draw hook 25 and can control same.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a weaving machine having plural heddles therein, a dobby and a Jacquard machine for simultaneously controlling the shed opening in said weaving machine, comprising a single information containing pattern card in said Jacquard machine, said Jacquard machine having plural Jacquard hooks therein, said dobby having at least one draw hook, at least one movably supported member and at least one draw hook control means therein, said draw hook control means operatively connecting said draw hook to said movably supported member for facilitating a selected positioning of said draw hook, plural first harness cords connecting a portion of said plural Jacquard hooks to said heddles in said weaving machine, at least one second harness cord connecting a one of said plural Jacquard hooks to said movably supported member, whereby operations of said Jacquard machine in response to the information on said pattern card will simultaneously effect an operation of said movable support member to selectively position said draw hook in said dobby.

2. The weaving machine according to claim 1, wherein said movably supported member which is connected to said second harness cord is movable between two positions, wherein said dobby includes a draw knife selectively connected to said draw hook when said movably supported member is in a first position, and wherein said draw hook control means is responsive to the position of said movably supported member to effect a movement of said draw hook into and out of the path of movement of said draw knife.

3. The weaving machine according to claim 2, wherein said movably supported member is a slide member which is secured to said second harness cord and has a cam surface thereon, wherein said draw hook control means includes a reading needle engaging said cam surface.

4. The weaving machine according to claim 3, wherein said cam surface has two supporting elevations.

5. The weaving machine according to claim 2, wherein said movably supported member is a pivotally supported clasp handle, the pivot axis of which is movable between said two positions, wherein said draw hook control means includes a two-arm rocking lever and a control lever operatively connected to said rocking lever, and wherein said clasp handle selectively engages one arm of said two-arm rocking lever in response to a movement of said pivot axis to one of said two positions to effect a movement of said rocking lever and said control lever to selectively position said draw hook.

6. The weaving machine according to claim 5, including means for urging said control lever against the direction of pull of said second harness cord.

* * * * *